US006684546B1

(12) United States Patent
Chang

(10) Patent No.: US 6,684,546 B1
(45) Date of Patent: Feb. 3, 2004

(54) PRINTED DECORATING PAINTING

(76) Inventor: Deng Chi Chang, No. 148-38, Sec. 3, Hsi Tun RD., Hsi Tun District, Taichung (TW)

( * ) Notice: Subject to any disclaimer, the term of this patent is extended or adjusted under 35 U.S.C. 154(b) by 0 days.

(21) Appl. No.: 10/338,863

(22) Filed: Jan. 9, 2003

(51) Int. Cl.[7] ..... A47G 1/06
(52) U.S. Cl. ..... 40/788; 40/743; 40/754
(58) Field of Search ..... 40/745, 743, 754, 40/788, 798, 768, 539; D6/303

(56) References Cited

U.S. PATENT DOCUMENTS 2,093,972 A * 9/1937 Ziemmerman ..... 40/788
3,286,387 A * 11/1966 Poertner ..... 40/788
3,354,560 A * 11/1967 Kuenzel ..... 40/788
4,782,611 A * 11/1988 Papov ..... 40/788
4,870,766 A * 10/1989 Topping ..... 40/788
D366,765 S * 2/1996 Mann ..... D6/303
5,720,123 A * 2/1998 Taylor ..... 40/768

* cited by examiner

*Primary Examiner*—Gary Hoge
(74) *Attorney, Agent, or Firm*—Rosenberg, Klein & Lee

(57) ABSTRACT

A printed decorating painting includes a box-like body having a thickness, and including a printing surface that is zero diopter processed and a frame portion surrounding the printing surface. The frame portion extends to a periphery of the box-like body. The frame portion includes multiple bright portions partially printed on the frame portion and the painting portion includes multiple shadow portions printed on the painting portion and each adjacent to a corresponding one of the bright portions of the frame portion to provide a three-dimensional vision sense between the painting portion and the frame portion.

7 Claims, 6 Drawing Sheets

PRINTED DECORATING PAINTING

BACKGROUND OF THE INVENTION

1. Field of the Invention

The present invention relates to a painting, and more particularly to a printed decorating painting.

2. Description of Related Art

A conventional frame (8) for a printed painting in accordance with the prior art shown in FIG. 8 comprises a first section (81), a second section (82) a third section (83) and a fourth section (84) connected to one another to form a receiving space (85) for receiving the printed painting within the frame (8). The conventional frame (8) for a printed painting usually is three-dimensional such that the conventional frame can set off by contrast to the printed painting and make the printed painting having a three-dimensional vision sense.

Generally speaking, the printed painting is very cheap and the conventional frame is made of wood such that the conventional frame is very expensive relative to the printed painting. Consequently, some frames made of paper are marketed for reducing the material cost. However, the paper made frame has complicated manufacturing process such that the manufacturing cost still has not reduced.

The present invention has arisen to mitigate and/or obviate the disadvantages of the conventional frames for a printed painting.

SUMMARY OF THE INVENTION

The main objective of the present invention is to provide an improved printed decorating painting.

To achieve the objective, the printed decorating painting in accordance with the present invention comprises a box-like body having a thickness, and including a printing surface that is zero diopter processed and a frame portion surrounding the printing surface. The frame portion extends to a periphery of the box-like body. The frame portion includes multiple bright portions partially printed on the frame portion and the painting portion includes multiple shadow portions printed on the painting portion and each adjacent to a corresponding one of the bright portions of the frame portion to provide a three-dimensional vision sense between the painting portion and the frame portion.

Further benefits and advantages of the present invention will become apparent after a careful reading of the detailed description with appropriate reference to the accompanying drawings.

DETAILED DESCRIPTION OF THE INVENTION

Figure 1:
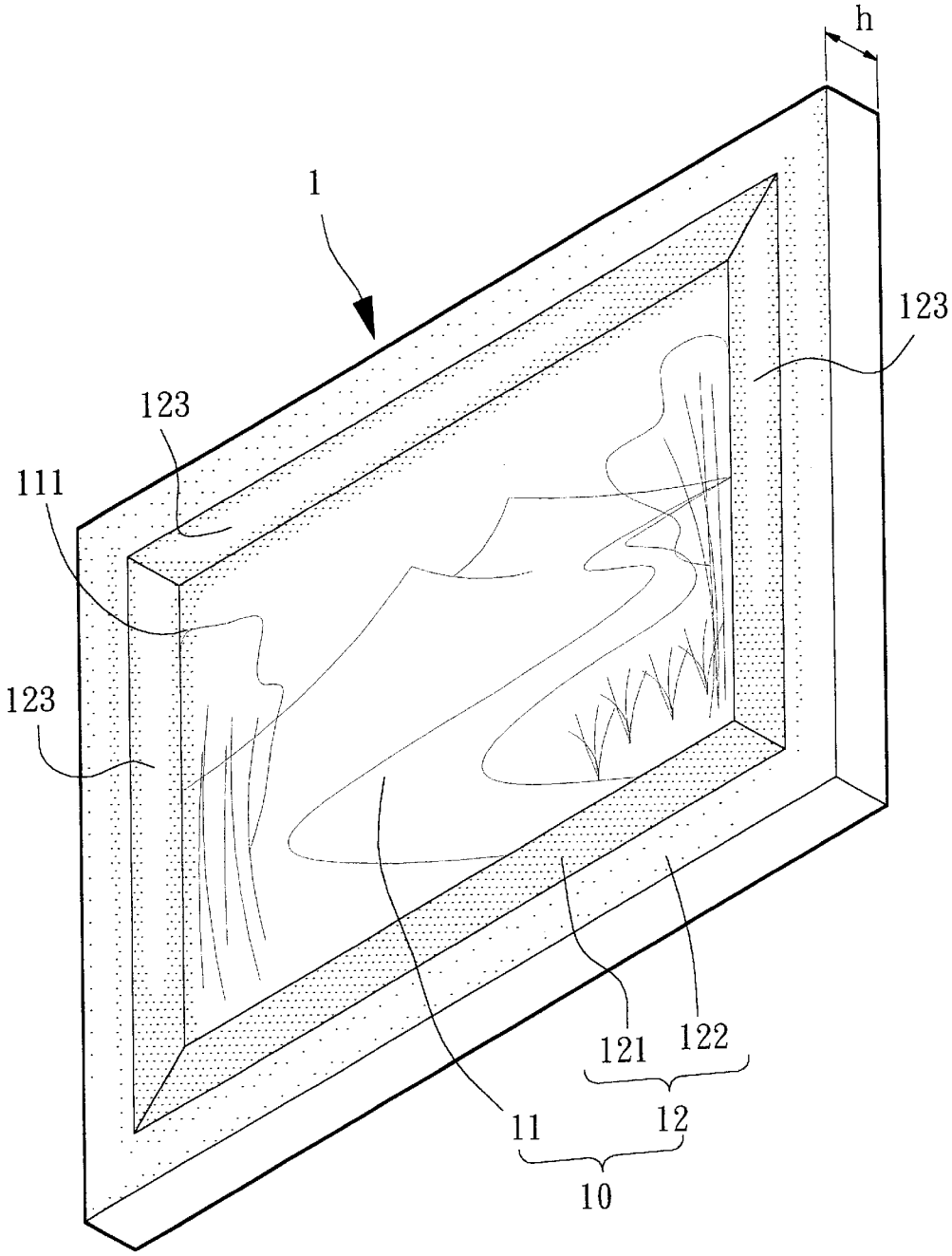
FIG. 1 is a front perspective view of a printed decorating painting in accordance with the present invention
Figure 2:
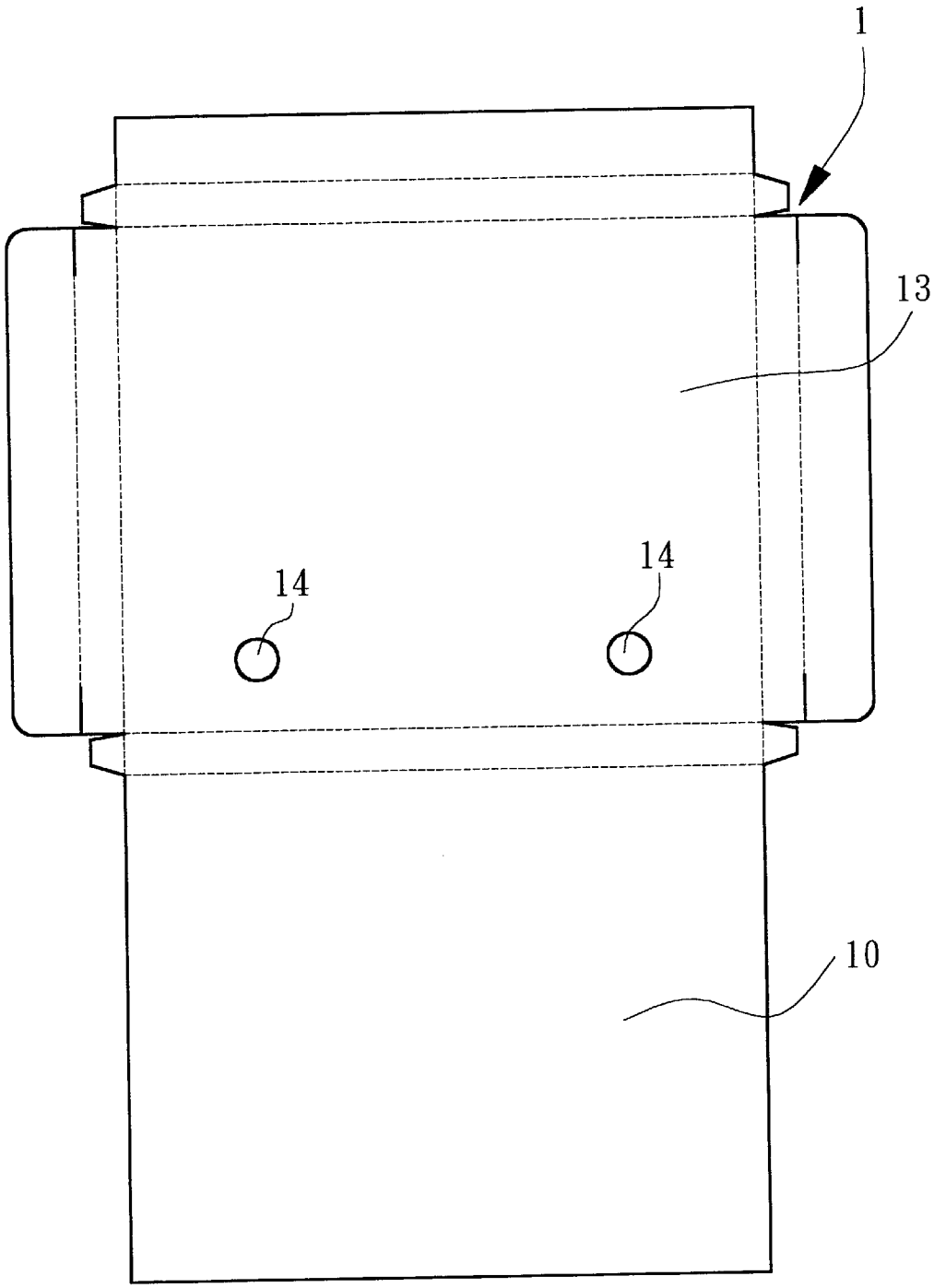
FIG. 2 is a unfold plan view of the printed decorating painting in FIG. 1.
Figure 3:
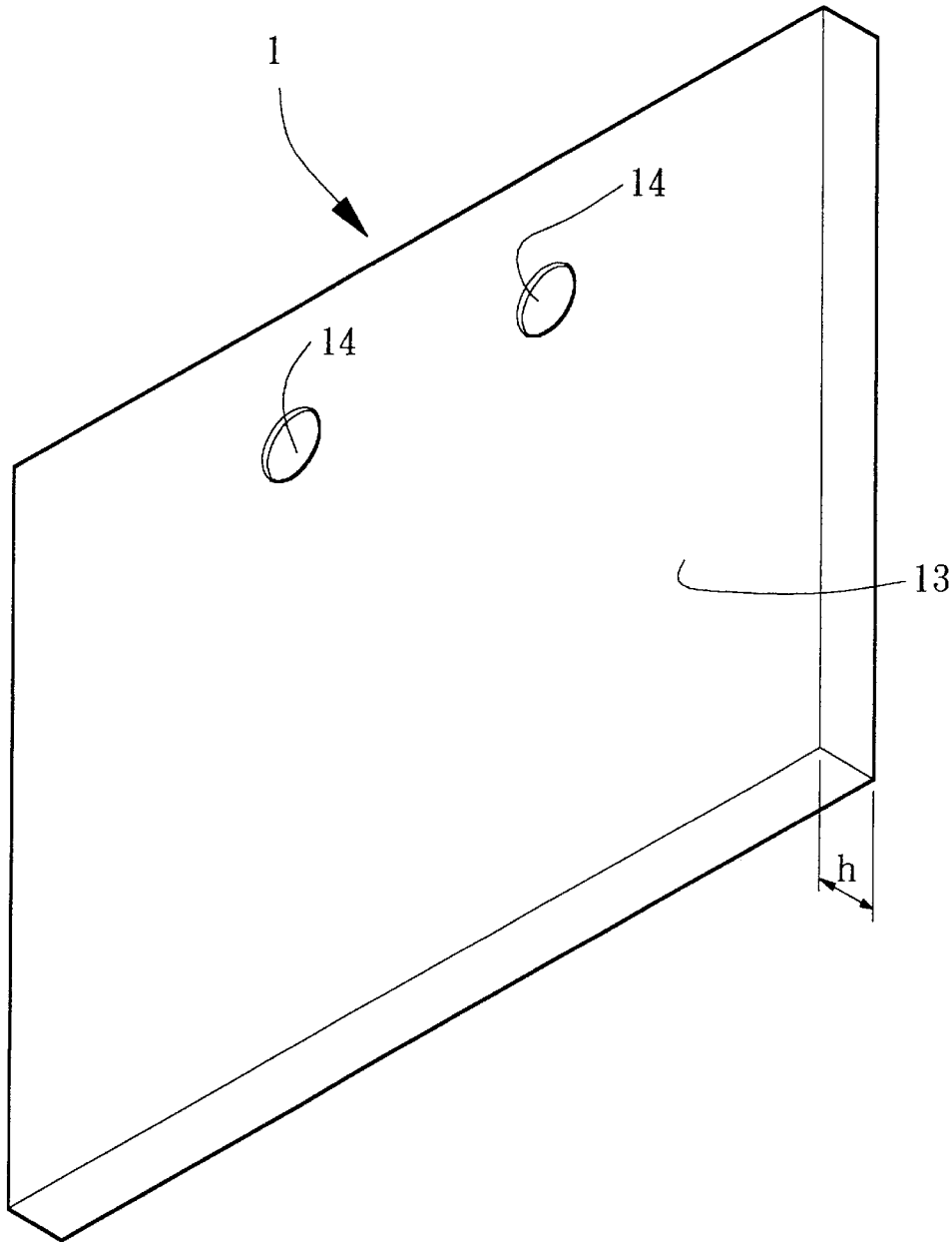
FIG. 3 is a rear perspective view of the printed decorating painting in FIG. 1.

Referring to the drawings and initially to FIGS. 1–3, a printed decorating painting in accordance with the present invention comprises a box-like body (1) made of cardboard or plastic board bent to form the box-like body (1). The box-like body (1) has a thickness (h). The box-like body (1) has a printing surface (10) that is non-reflective processed. The printing surface (10) includes a painting portion (11) centrally formed on the printing surface (10) and a frame portion (12) surrounding the painting portion (11). In the preferred embodiment of the present invention, the frame portion (12) has a color different from that of the painting portion (11). The frame portion (12) includes an inner frame (121) surrounding the painting portion (11) and an outer frame (122) surrounding the inner frame (121) and extending to a periphery of the box-like body (1). There is a chromatism formed between the inner frame (121) and the outer frame (122) to provide a three-dimensional vision between the painting portion (11) and the frame portion (12).

The frame portion (12) has multiple bright portions (123) partially printed on the inner frame (121) except a bottom side of the frame portion. The painting portion (11) has multiple shadow portions (111) printed on the painting portion and each adjacent to a corresponding one of the bright portions (123) of the frame portion (12). Consequently, a three-dimensional vision sense is formed between the frame portion (12) and the painting portion (11).

The box-like body (1) includes a rear surface (13) opposite to the printing surface and installed with a fixing member (14). In the preferred embodiment of the present invention, the fixing member (14) includes at least one aperture defined in the rear surface (13) of the box-like body (1). The aperture is provided to receive a hook that is secured on a wall for hanging the present invention on the wall.

The present invention is made of cardboard or plastic board such that the material cost is greatly reduced. Furthermore, the body (1) of the present invention is box-like such that the present invention can be used as a packing box and retrieved as an ornament after being used to achieve an objective of environmental protection.

Figure 4:
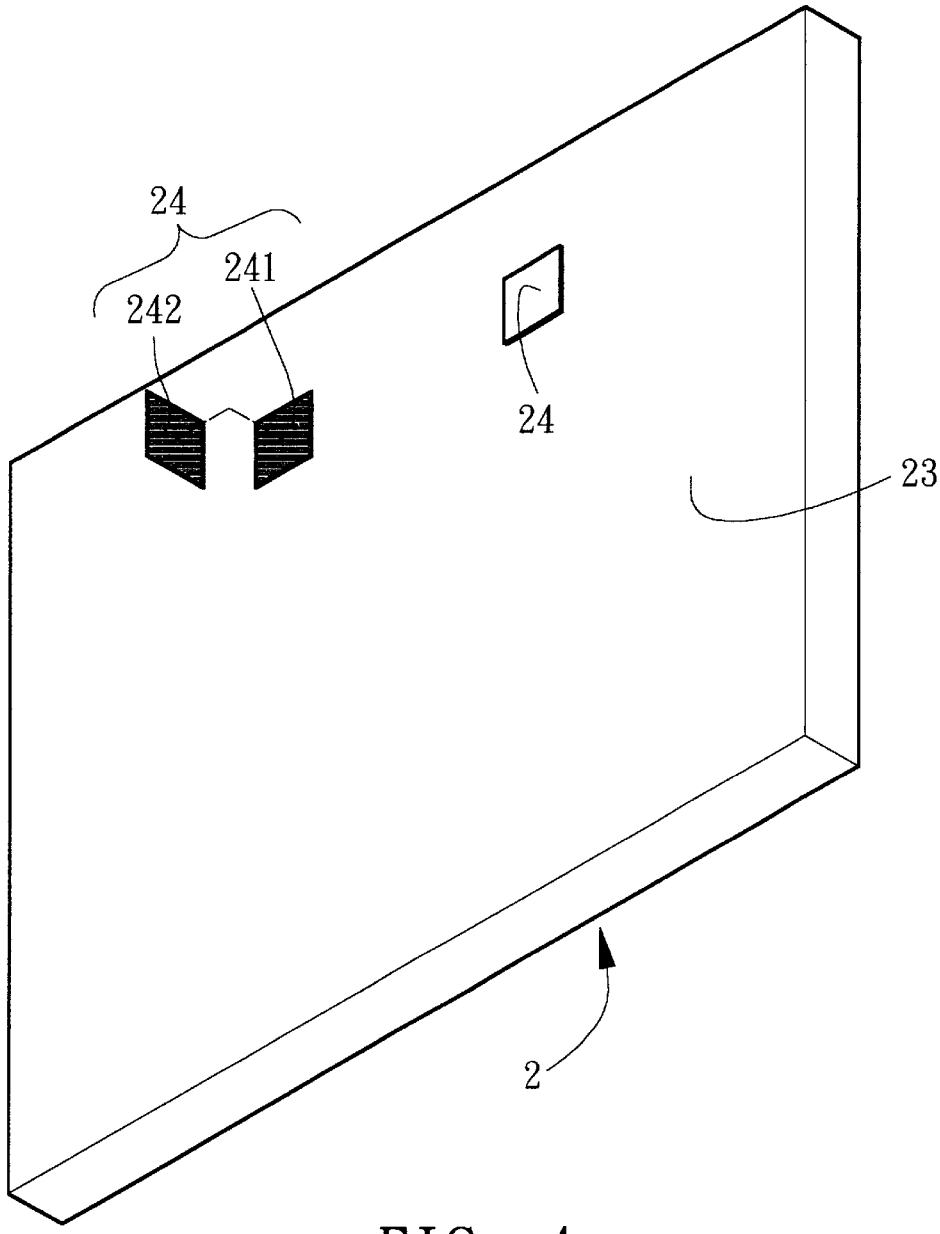
FIG. 4 is a rear perspective view of a second embodiment of the fixing member of the printed decorating painting in accordance with the present invention.

With reference to FIG. 4, it shows a second embodiment of the fixing member in accordance with the present invention. In the preferred embodiment, the fixing member is an adhering device (24). The adhering device (24) includes a hook strap (241) attached to the rear surface (23) of the box-like body (2) and a loop strap (242) secured on the wall such that the present invention is fixed on the wall when the hook strap (241) is contacted with the loop strap (242).

Figure 5:
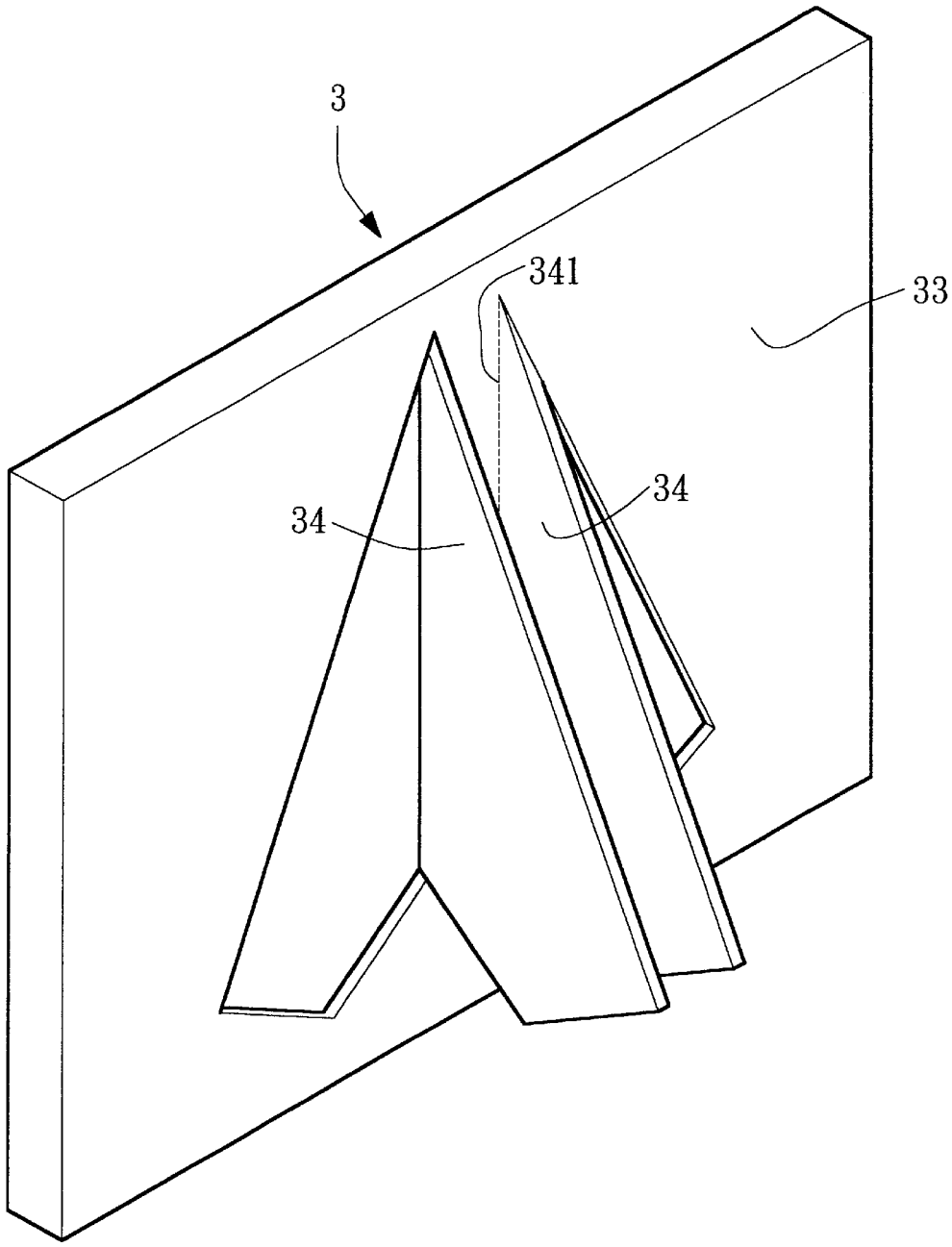
FIG. 5 is a rear perspective view of a second embodiment of the printed decorating painting in accordance with the present invention.
Figure 6:
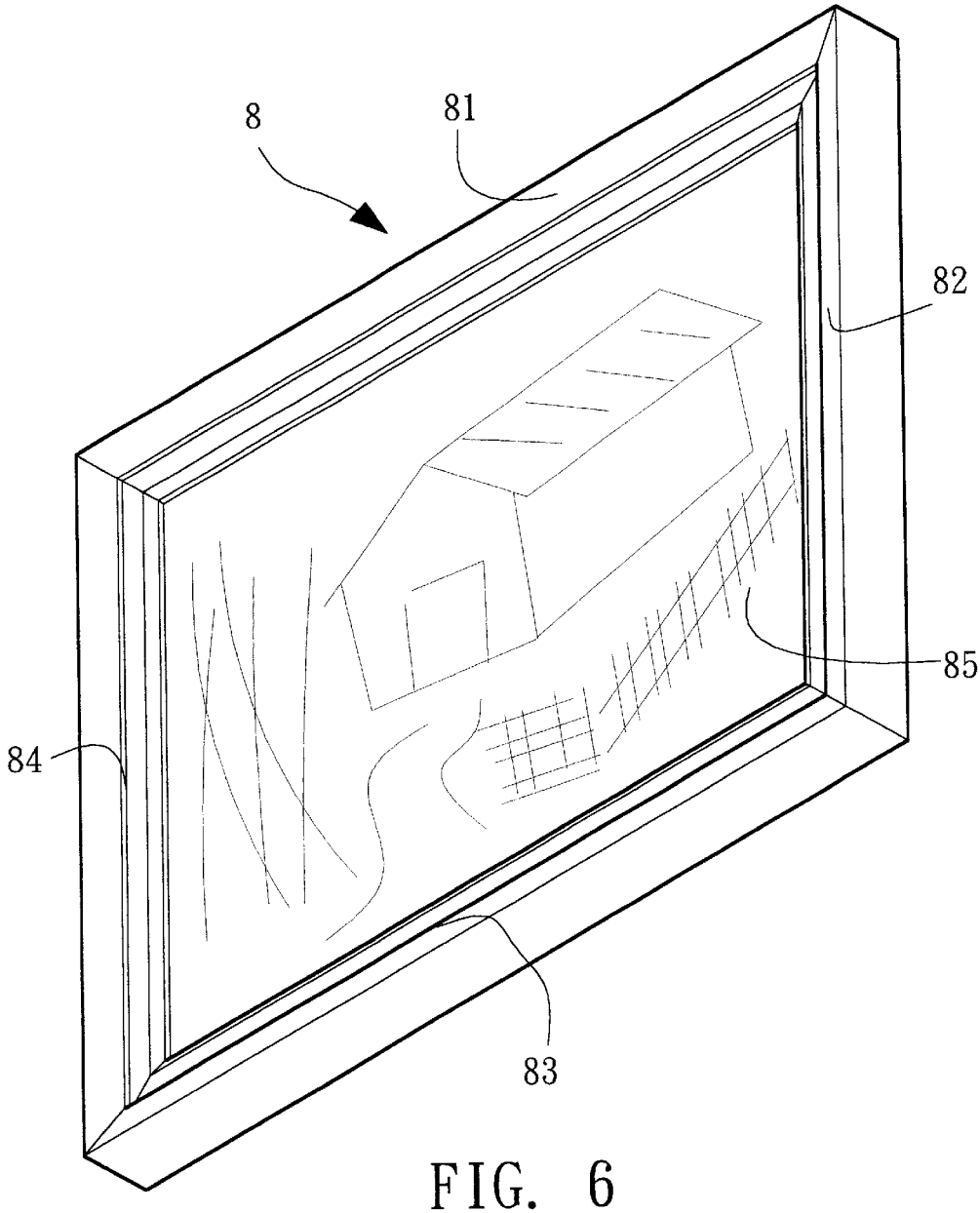
FIG. 6 PRIOR ART
FIG. 6 is perspective view of a printed decorating painting in accordance with the prior art.

With reference to FIG. 5, it shows a second embodiment of the present invention wherein the box-like body (3) includes two stands (34) for supporting the box-like body (3) on a supporting surface. The two stands (34) are cut from the rear surface (33) of the box-like body (3). Each stand (34) is bent opposite to the printing surface (10) along a bending line (341) on the rear surface (33). The two bending lines (341) are parallel to each other.

Although the invention has been explained in relation to its preferred embodiment, it is to be understood that many other possible modifications and variations can be made without departing from the spirit and scope of the invention as hereinafter claimed.

What is claimed is:

1. A printed decorating painting comprising a box-like body having a thickness, and including a printing surface and a frame portion surrounding the printing surface, the frame portion extending to a periphery of the box-like body, the frame portion including multiple bright portions partially printed on the frame portion and the painting portion including multiple shadow portions printed on the painting portion and each adjacent to a corresponding one of the bright portions of the frame portion to provide a three-dimensional vision sense between the painting portion and the frame portion.

2. The printed decorating painting as claimed in claim 1, wherein the frame portion comprises an inner frame surrounding the painting portion and an outer frame surrounding the inner frame and extending to a periphery of the box-like body, the multiple bright portions printed on the inner frame such that a visual effect is formed between the inner frame and the outer frame to provide a three-dimensional vision sense.

3. The printed decorating painting as claimed in claim 1, wherein the box-like body comprises a rear surface opposite to the printing surface and installed with a fixing member adapted for handing the box-like body on a wall.

4. The printed decorating painting as claimed in claim 3, wherein the fixing member includes at least one aperture defined in the rear surface of he box-like body, the at least one aperture adapted to receive a hook on a wall for hanging the box-like body on the wall.

5. The printed decorating painting as claimed in claim 3, wherein the fixing member is an adhering device that includes a hook strap attached to the rear surface of the box-like body and a loop strap adapted to be secured on a wall such that the box-like body is fixed on a wall when the hook strap is contacted with the loop strap.

6. The printed decorating as claimed in claim 1, wherein the box-like body comprises two stands for supporting the box-like body on a supporting surface, the two stands cut from the rear surface of the box-like body, each stand bent opposite to the printing surface along a bending line on the rear surface, the two bending lines parallel to each other.

7. The printed decorating painting as claimed in claim 2, wherein the box-like body comprises two stands for supporting the box-like body on a supporting surface, the two stands cut from the rear surface of the box-like body, each stand bent opposite to the printing surface along a bending line on the rear surface, the two bending lines parallel to each other.

* * * * *